US005351422A

United States Patent [19]

Fitzgerald

[11] Patent Number: 5,351,422

[45] Date of Patent: Oct. 4, 1994

[54] REPLACEMENT CLEAT METHOD AND APPARATUS FOR CONVENTIONAL GOLF SHOE CLEATS

[76] Inventor: John E. Fitzgerald, 3500 Palmer Dr., Titusville, Fla. 32780

[21] Appl. No.: 898,418

[22] Filed: Jun. 15, 1992

[51] Int. Cl.[5] ..... A43C 15/00; A43B 5/00

[52] U.S. Cl. ..... 36/134; 36/67 A; 36/67 D

[58] Field of Search ..... 36/134, 127, 67 R, 67 A, 36/67 B, 67 D

[56] References Cited

U.S. PATENT DOCUMENTS

| | | | |
|---|---|---|---|
| 3,496,656 | 2/1970 | Caine | 36/67 A |
| 4,159,582 | 7/1979 | Ostrowski | 36/67 D |
| 4,698,924 | 10/1987 | Greiner et al. | 36/134 |
| 4,873,774 | 10/1989 | Lafever | 36/134 |

FOREIGN PATENT DOCUMENTS

| | | | |
|---|---|---|---|
| 3046811 | 7/1982 | Fed. Rep. of Germany | 36/134 |
| 0223700 | 5/1987 | France | 36/127 |

*Primary Examiner*—Paul T. Sewell
*Assistant Examiner*—M. D. Patterson

[57] ABSTRACT

A conventional fixed cleat of a golf shoe is replaced with a retractable cleat formed in a unitary body defining a plate with an inside flat surface and an insert member extending laterally from the flat surface, the insert member having threads about its periphery generally corresponding in diameter and length to the threads of a conventional fixed golf cleat. An axial hole extends through the plate and the insert member, and a biasing member and a retractable cleat extend through the axial hole so that the biasing member pushes the retractable cleat outwardly. A unitary flange covers the axial hole at the distal extremity, to retain the biasing member.

4 Claims, 1 Drawing Sheet

REPLACEMENT CLEAT METHOD AND APPARATUS FOR CONVENTIONAL GOLF SHOE CLEATS

BACKGROUND OF THE INVENTION

The present invention relates generally to retractable cleats for shoes, and in particular relates to a method and apparatus for providing a retractable cleat capable of replacing a conventional fixed cleat useful on golf shoes or similar footwear.

The prior art discloses a number of techniques and constructions for retractable cleats useful on footwear. For example, Norwegian Patent 69,127 to Malmqvist discloses a retractable cleat extensible in and out of a housing, and with a cylindrical spring biasing the cleat out of the housing. Similar arrangements are disclosed in the following prior art patent documents: French Patent 2,567,004 to Jarr; German Patent 3,046,811 A1 to Dassler; U.S. Pat. No. 1,361,078 to Lynn; and U.S. Pat. No. 4,873,774 to Lafever.

Other prior art of interest includes the following U.S. Pat. Nos.: 3,717,238 to Fox; 3,793,751 to Gordos; 4,271,608 to Tomuro; 4,375,729 to Buchanen, III; 4,715,133 to Hartjes et al; 4,821,434 to Chein; and 4,825,562 to Chuang. See also German Patent 3,644,812 to Schaffler.

SUMMARY OF THE INVENTION

The present invention has among its objectives the method and apparatus for providing a retractable cleat capable of facile replacement of a conventional fixed cleat of a golf shoe. To this end, the method of the present invention comprises the steps of providing a plate with an inside flat surface and a unitary insert member extending laterally from the inside flat surface, the insert member having threads about its periphery which generally correspond in diameter and length to the threads of a conventional fixed golf cleat. An axial hole is formed through the plate and the insert member by drilling a first hole from an outside flat surface of the plate inwardly, and thereafter drilling a second, larger hole axially through the insert member to form a shoulder within the axial hole corresponding to a like shoulder on a retractable cleat which is fitted within the axial hole and extensible into and out of the hole from the outside flat surface of the plate. A biasing member is also fitted within the axial hole between a unitary flange formed across the extremity of the second hole at the distal end of the insert member and the inside surface of the retractable cleat, to effectuate the biasing of the cleat out of the hole and away from the outside flat surface.

In the preferred form of the method contemplated by this inventions, the plate and the insert member are machined from a unitary metal body, with the axial hole through the plate and insert member being formed by the two-step drawing technique described above. After insertion of the retractable cleat and the biasing member, which preferably comprises a conical spring, the distal end of the insert member is crimped to form the flange which retains the larger end of the conical spring.

THE DRAWING

DETAILED DESCRIPTION

Figure 1:
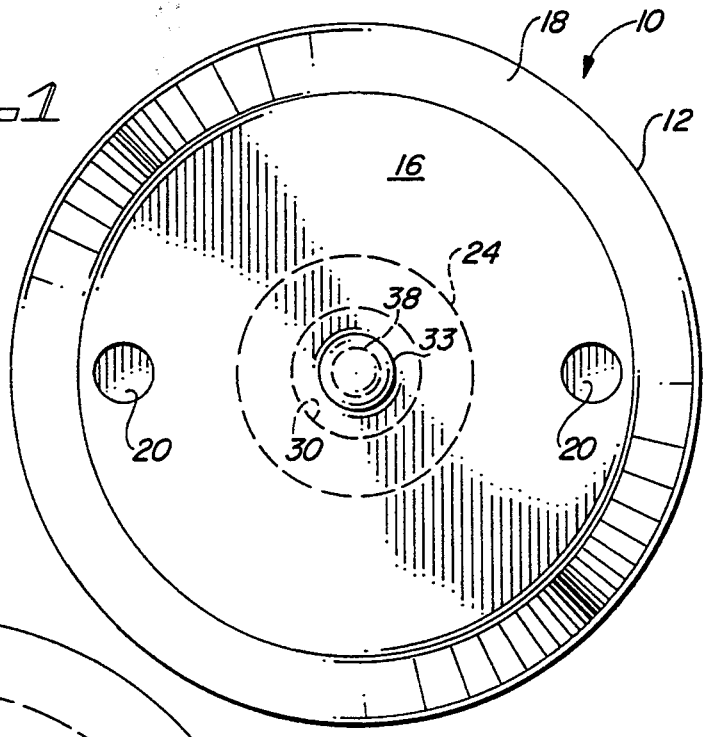
FIG. 1 is a top plan view of a retractable cleat in accordance with the present invention.
Figure 2:
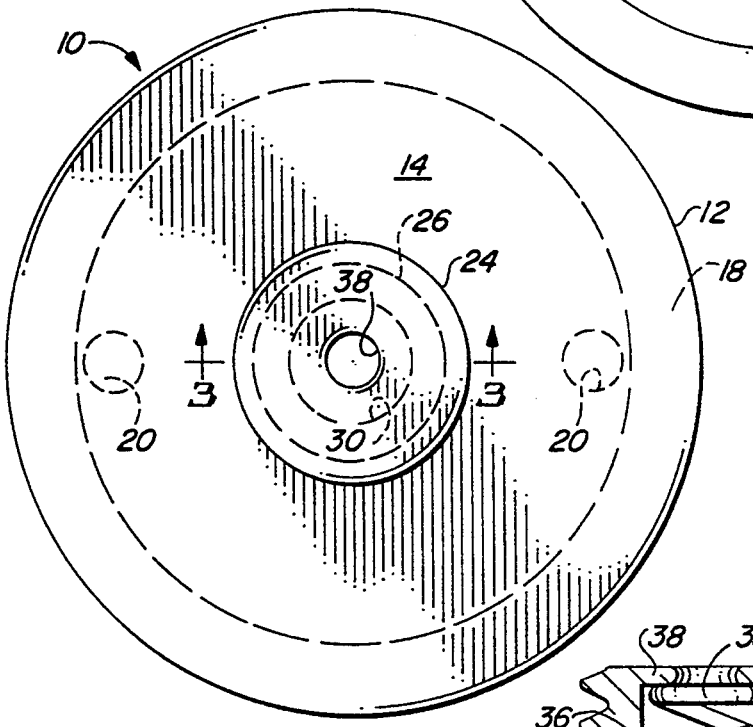
FIG. 2 is a rear plan view of the retractable cleat of FIG. 1.

The method and apparatus for providing a replacement cleat capable of being installed in place of a conventional fixed cleat of a golf shoe will be described with reference to FIGS. 1-3.

The retractable cleat, referred to generally by the reference numeral 10, is formed in a unitary body, preferably of a high strength steel, to define a plate 12 having opposing inside and outside flat surfaces 14, 16 respectively. A bevelled surface 18 is provided along the periphery of the outside flat surface 16 in order to enable the cleat to be inserted and removed from a golf shoe using a conventional tool for that purpose (not shown).

Figure 3:
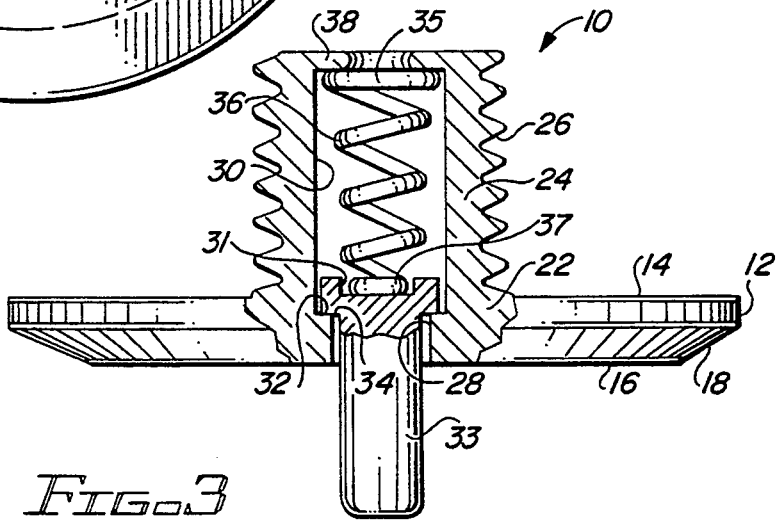
FIG. 3 is a side view of the retractable cleat shown in FIGS. 1 and 2, with a portion shown in the cross section along line 3—3 in FIG. 2.

As more particularly shown in the cross section of FIG. 3, the retractable cleat 10 is machined from the unitary body so as to define a unitary neck 22 extending away from the inside flat surface 14 into an insert member 24, the periphery of which contains threads 26. The length of the insert member 24 and the particular form of the threads 26 is not critical, but preferably the dimension and thread spacing of insert member 24 and threads 26 is such as to permit the retractable cleat 10 to be retrofitted into a conventional golf shoe, in order to replace a conventional golf shoe cleat. It will of course be appreciated by those skilled in the art that the fabrication of the retractable cleat 10 from a high strength, unitary body so as to define rising neck portion 22 and insert member 24 permits the retractable cleat to be formed in a low cost, facile manner while providing a high degree of structural strength.

Further in accordance with the present invention, the retractable cleat 10 includes an axial hole extending from the distal extremity of the insert member 24, through the insert member and through the plate member 12 between the inside and outside flat surfaces 14, 16. In the preferred form, the axial hole is formed by drilling two separate axial holes, including a first axial hole 28 extending from the outside flat surface 16 of the plate 12, inwardly a distance less than the entire dimension between the two flat surfaces, 14, 16. A second axial hole 30 is drilled from the distal extremity of the insert member 24 inwardly to the junction with the first axial hole 28, the second hole 30 having a somewhat greater diameter than the first axial hole 28 so as to define a shoulder 32.

The retractable cleat 10 is further provided with a cleat member 33 having a shoulder 34 corresponding to the shoulder 32 defined between the axial holes 28, 30. In this way, the cleat member 33 is retained within the plate 12, and prevented from exiting the first axial hole 28. The cleat 10 also includes an inner recess 31.

A biasing member in the form of a conical spring 36 is placed within the second axial hole 30, and the insert member 24 is then crimped at its distal end to form a retaining flange 38. The larger end 35 of the conical spring 36 is held within the flange 38 and the smaller end 37 fits within the recess 31. Again, because of the high strength nature of the material forming the unitary body comprising the plate 12 and the insert member 24, the flange 38 defines a strong retaining construction which may be easily and simply formed during the fabrication of the retractable cleat 10.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method for replacing a conventional fixed cleat of a golf shoe with a retractable cleat, comprising the steps of:

providing a plate with an inside flat surface and a unitary insert member extending perpendicularly from the flat surface, the insert member having threads about its periphery generally corresponding in diameter and length to the threads of a conventional fixed golf cleat;

forming an axial hole through the plate and the insert member;

fitting a biasing member and a retractable cleat through the axial hole so that the biasing member pushes the retractable cleat outwardly, the cleat extending into the hole when sufficient axial pressure is exerted on the cleat; and limiting the movement of the cleat member out of the axial hole by fitting the plate and an inside end of the cleat with corresponding retaining shoulders, the retaining shoulders fitting step comprising the steps of drilling a first hole in the plate from an outside surface opposite the inside surface, the first hole axial with the center line of the insert member; and drilling a second hole axial with the first hole through the insert member and into a portion of the plate member, the second hole having a dimension greater than the first hole.

2. The method recited in claim 1 wherein the plate and insert member providing step comprises forming the plate and the insert member from a unitary metal body.

3. The method recited in claim 1 further comprising the step of forming an inward flange at the extremity of the insert member for retaining the biasing member.

4. The method recited in claim 3 wherein the step of fitting a biasing member comprises the steps of inserting a spring through the axial hole and engaging a distal end of the spring in the flange at the distal extremity of the insert member.

* * * * *